US009364709B2

(12) United States Patent
Butler et al.

(10) Patent No.: US 9,364,709 B2
(45) **Date of Patent: *Jun. 14, 2016**

(54) COMPACT PORTABLE LEG EXERCISE MACHINE

(71) Applicants: Ying Y. Butler, Pasadena, CA (US); John W. Butler, Pasadena, CA (US)

(72) Inventors: Ying Y. Butler, Pasadena, CA (US); John W. Butler, Pasadena, CA (US)

( * ) Notice: Subject to any disclaimer, the term of this patent is extended or adjusted under 35 U.S.C. 154(b) by 44 days.

This patent is subject to a terminal disclaimer.

(21) Appl. No.: 14/508,092

(22) Filed: Oct. 7, 2014

(65) Prior Publication Data

US 2015/0321043 A1 Nov. 12, 2015

Related U.S. Application Data

(63) Continuation of application No. 14/272,772, filed on May 8, 2014, now Pat. No. 8,864,633.

(51) Int. Cl.
*A63B 23/08* (2006.01)
*A63B 23/10* (2006.01)
(Continued)

(52) U.S. Cl.
CPC ..... *A63B 23/0405* (2013.01); *A63B 21/023* (2013.01); *A63B 21/05* (2013.01);
(Continued)

(58) Field of Classification Search
CPC ..... A63B 5/08; A63B 21/02; A63B 21/023; A63B 21/04; A63B 21/0407; A63B 21/0428; A63B 21/0442; A63B 21/05; A63B 2005/08; A63B 2005/085
USPC ..... 482/30–32, 51–53, 79–80, 92, 482/111–113, 121, 128, 910
See application file for complete search history.

(56) References Cited

U.S. PATENT DOCUMENTS 406,328 A 7/1889 Yagn
1,548,849 A 8/1925 Ruden
(Continued)

FOREIGN PATENT DOCUMENTS

AU 2010201559 A1 11/2010
CN 202207433 U 5/2012
(Continued)

OTHER PUBLICATIONS

Sit-N-Stroll Portable Foot Exerciser shown on webpage: http://www.amazon.com/Sun-Mate-Corp-Sit-N-Stroll-Portable-Exerciser/dp/B0002L9R7E; Display date: believed to have published before the filing of this application. Retrieval date: May 13, 2014.
(Continued)

*Primary Examiner* — Oren Ginsberg
(74) *Attorney, Agent, or Firm* — Knobbe Martens Olson & Bear, LLP

(57) ABSTRACT

A compact portable leg exercise apparatus includes a top platform, a base member, a resilient member and a frame assembly interposed between the top platform and base member. The apparatus is sized to receive a foot onto the top platform to move the top platform relative to the base member and against a force provided by the resilient member as the apparatus is moved to the collapsed position. The apparatus is sized to fit in carryon luggage, handbag, backpack or be hand-carried, allowing for its use anywhere. The frame assembly aligns the top platform and base member and inhibits twisting motion of the top platform relative to the base member, thereby constraining the motion of travel for the apparatus. The frame assembly can include a plurality of hinged leaf pairs shaped to inhibit generation of noise by the frame assembly as it moves to the collapsed configuration during use of the exercise apparatus. The exercise apparatus is light weight, small, quiet and stable, allowing for it use at home, the office, in public, in the airplane, or even within a vehicle.

19 Claims, 7 Drawing Sheets

(51) Int. Cl.

| | |
|---|---|
| ***A63B 21/05*** | (2006.01) |
| ***A63B 23/04*** | (2006.01) |
| ***A63B 21/00*** | (2006.01) |
| ***A63B 21/02*** | (2006.01) |
| ***A63B 23/035*** | (2006.01) |
| *A63B 21/008* | (2006.01) |

(52) U.S. Cl.

CPC ..... *A63B21/1465* (2013.01); *A63B 23/03508* (2013.01); *A63B 23/04* (2013.01); *A63B 21/0083* (2013.01); *A63B 21/0087* (2013.01); *A63B 21/028* (2013.01); *A63B 2208/0233* (2013.01); *A63B 2210/50* (2013.01)

(56) References Cited

U.S. PATENT DOCUMENTS

| | | | |
|---|---|---|---|
| 1,613,538 | A | 1/1927 | Schad |
| 2,022,002 | A | 11/1935 | Jacks |
| 2,494,094 | A | 1/1950 | Horstman |
| 2,830,816 | A | 4/1958 | Uhl |
| D185,322 | S | 5/1959 | Scholl |
| 3,228,392 | A | 1/1966 | Speyer |
| 3,295,847 | A | 1/1967 | Matt, Sr. |
| 3,497,216 | A | 2/1970 | Feather |
| 3,497,217 | A | 2/1970 | Feather |
| 3,749,400 | A | 7/1973 | Stoffel |
| 4,111,416 | A | 9/1978 | Jinotti |
| 4,211,404 | A | 7/1980 | Blowsky et al. |
| 4,248,421 | A | 2/1981 | Salazar |
| 4,279,415 | A | 7/1981 | Katz |
| 4,371,160 | A | 2/1983 | Shooltz |
| 4,501,421 | A | 2/1985 | Kane et al. |
| 4,660,299 | A | 4/1987 | Omilusik |
| 4,739,986 | A | 4/1988 | Kucharik et al. |
| 4,775,148 | A | 10/1988 | Mclaughlin |
| 4,909,506 | A | 3/1990 | Smith |
| 4,911,437 | A | 3/1990 | Schulkin |
| 5,050,875 | A | 9/1991 | Lewkovich |
| 5,069,445 | A | 12/1991 | Mai |
| 5,154,685 | A | 10/1992 | Chen |
| 5,197,934 | A | 3/1993 | Wirtz |
| 5,352,173 | A | 10/1994 | McLaughlin |
| 5,413,543 | A | 5/1995 | Drago |
| D383,813 | S | 9/1997 | Zoller |
| 5,690,594 | A | 11/1997 | Mankovitz |
| D397,746 | S | 9/1998 | Drach et al. |
| 6,024,678 | A | 2/2000 | Solomon |
| 6,402,667 | B1 | 6/2002 | Dahn |
| 6,402,669 | B1 | 6/2002 | Olstad |
| 6,705,975 | B2 | 3/2004 | Kuo |
| 6,709,368 | B1 | 3/2004 | Chue |
| 6,743,159 | B1 | 6/2004 | Taylor et al. |
| 6,796,928 | B1 | 9/2004 | Christopher et al. |
| 6,976,939 | B2 | 12/2005 | Harker et al. |
| 7,645,221 | B1 | 1/2010 | Curry |
| 7,824,315 | B2 | 11/2010 | Piaget et al. |
| D631,107 | S | 1/2011 | Gillis |
| 8,029,420 | B1 | 10/2011 | Thati |
| 8,105,219 | B1 | 1/2012 | Sloan et al. |
| 8,133,160 | B2 | 3/2012 | Verheem |
| D666,013 | S | 8/2012 | Harrison |
| D671,998 | S | 12/2012 | Rodriguez, Jr. |
| 8,617,033 | B2 | 12/2013 | Stewart |
| D722,349 | S | 2/2015 | Smyth |
| D724,162 | S | 3/2015 | James |
| D726,844 | S | 4/2015 | Mathew et al. |
| 2007/0298949 | A1 | 12/2007 | Soletski |
| 2012/0214650 | A1 | 8/2012 | Jahns |
| 2014/0162852 | A1 | 6/2014 | Ho et al. |

FOREIGN PATENT DOCUMENTS

| | | | |
|---|---|---|---|
| CN | 201120354336 | | 5/2012 |
| GB | 2404877 | | 2/2005 |
| JP | 60-106468 | A | 6/1985 |
| JP | 2008-178431 | A | 8/2008 |
| KR | 20-0451744 | Y1 | 1/2011 |
| SU | 791377 | | 12/1980 |

OTHER PUBLICATIONS

Blood Circulation Sitting Walker and Massager shown on webpage: http://www.amazon.com/Blood-Circulation-Sitting-Walker-Massager/dp/B002MNDUIW/ref=cm_cr_pr_product_top; Display date: believed to have published before the filing of this application. Retrieval date: May 13, 2014.

Mini Sit N Stroll Blood Circulation Walk While Seated Airplanes Office shown on webpage: http://compare.ebay.com/like/380329476060?var=lv&ltyp=AllFixedPriceItemTypes&var=sbar&_lwgsi=y; Display date: believed to have published before the filing of this application. Retrieval date: May 13, 2014.

NordicTrack Mini Stepper and Exercise Peddler shown on webpage: http://www.nordictrack.com/webapp/wcs/stores/servlet/Product_-1_10301_12401_19555_71701; Display date: believed to have published before the filing of this application. Retrieval date: May 13, 2014.

Exercise Peddler shown on webpage: http://www.amazon.com/gp/product/B002VWK09Q/ref=pd_lpo_k2_dp_sr_1?pf_rd_p=486539851&pf_rd_s=lpo-top-stripe-1&pf_rd_t=201&pf_rd_i=B0018Q1BTY&pf_rd_m=ATVPDKIKX0DER&pf_rd_r=1KNAQA2AJZNF4ZE1Z9CR; Display date: believed to have published before the filing of this application. Retrieval date: May 13, 2014.

International Search Report and Written Opinion mailed on Jul. 24, 2015 in PCT Application No. PCT/US2015/029526.

Notice of Allowance mailed on May 21, 2015 in U.S. Appl. No. 29/490,270.

COMPACT PORTABLE LEG EXERCISE MACHINE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

1. Field

This invention relates in general to body exercise devices and more particularly to a compact and portable leg exercise apparatus.

2. Description of the Related Art

Our fast paced world has made it difficult for people to obtain enough physical exercise. Additionally, long work hours or commute time, or other demands on a person's time (e.g., on family matters), make it hard for individuals to find time to exercise. Those who sit for long periods of time (e.g., office workers, travelers on airplanes, buses, etc.) are at a risk of developing blood clots in major blood vessels. To efficiently use available exercise time, it is highly desirable to provide an exercise device that is small, compact and easy to use.

Existing leg exercise devices are either too big (e.g., those found in professional gyms) so that they are not easily portable, too bulky so that they cannot easily be carried (e.g., in a carryon luggage, large purse or bag, hand carried), noisy when used, require additional equipment (e.g., batteries, motors), or are too complicated (e.g., large stair master machines) thereby making their use impractical (e.g., for older individual) or restricting where the devices can be used.

Accordingly, there is a need for a compact and portable leg exercise device that can easily be stored in carryon luggage, backpack, or large purse, or hand-carried so that it can be used when desired (e.g., at work while sitting at a desk, while traveling on an airplane, bus, car) and that addresses one or more of the deficiencies noted above with existing leg exercise devices.

SUMMARY

In accordance with one aspect of the disclosure, a compact portable leg exercise device is provided. The device comprises a base member positionable on a support surface and a top platform disposed above and generally parallel to the base member and configured to move axially relative to the base member, the top platform configured to receive a user's foot thereon during use of the leg exercise device. The device also comprises a resilient member interposed between the base member and top platform and extending about a central axis of the device. The device also comprises a frame assembly fixedly coupled to and interposed between the top platform and base member, the frame assembly being co-axial with the resilient member. The frame assembly is configured to move between an extended configuration and a collapsed configuration to facilitate axial movement of the top platform relative to the base member while inhibiting twisting of the top platform about the central axis. In the extended configuration the top platform is supported solely by the resilient member and frame assembly. During use a user can push with their foot on the top platform to move the top platform generally axially toward the base member and against a force exerted by the resilient member on the top platform during said motion.

In accordance with another aspect of the disclosure, a compact portable leg exercise device is provided. The device comprises a base member positionable on a support surface and a top platform disposed above and generally parallel to the base member and configured to move axially relative to the base member, the top platform configured to receive a user's foot thereon during use of the leg exercise device. The device also comprises a coil spring interposed between the base member and top platform and extending about a central axis of the device. The device also comprises a frame assembly fixedly coupled to and interposed between the top platform and base member, the frame assembly being co-axial with and disposed within a periphery of the coil spring such that the coil spring circumscribes the frame assembly. The frame assembly is configured to move between an extended configuration and a collapsed configuration to facilitate axial movement of the top platform relative to the base member while inhibiting twisting of the top platform about the central axis. In the extended configuration the top platform is supported solely by the resilient member and frame assembly. During use a user can push with their foot on the top platform to move the top platform generally axially toward the base member and against a force exerted by the resilient member on the top platform during said motion.

This portable spring-type leg exerciser is designed for office workers, home exercisers and busy travelers. The leg exerciser reduces numbness in the legs and may inhibit (e.g., prevent) blood clots and swelling. It is small enough to be used under a desk at work. It is also light enough to be carried around and quiet enough to be used even in a public area. This quite, lightweight exerciser can be easily carry around and used everywhere.

DETAILED DESCRIPTION

FIGS. 1-3C show one embodiment of an exercise apparatus 10. In one embodiment, the exercise apparatus 10 can be used by user to exercise a leg (e.g., while sitting down, such as while sitting at a desk, on an airplane seat). Advantageously, the exercise apparatus 10 is portable and compact, allowing the apparatus 10 to be easily carried (e.g., in carryon luggage, a handbag, large purse, hand-carried, etc.), such that it can be used at various locations (e.g., at work, at a hotel while traveling, while on an airplane, train, boat, etc.). In one embodiment, as shown in FIGS. 1-3C, the exercise apparatus 10 is sized to receive one of the user's feet thereon. The user can thus use a pair of separate exercise apparatuses 10 placed proximate each other, where the user can push down on one of the exercise apparatuses 10 with their left foot and push on the other of the exercise apparatuses 10 with their right foot. Alternatively, the user can use a single exercise apparatus 10 to exercise both their legs, alternatively exercising their left and right leg with the exercise apparatus 10.

Figure 3A:
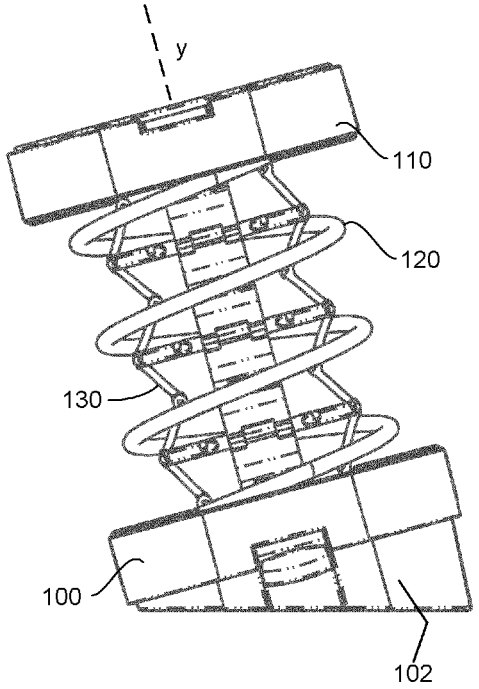
FIG. 3A is a right side view of the assembled leg exercise apparatus of FIG. 1A in the open position.
Figure 2B:
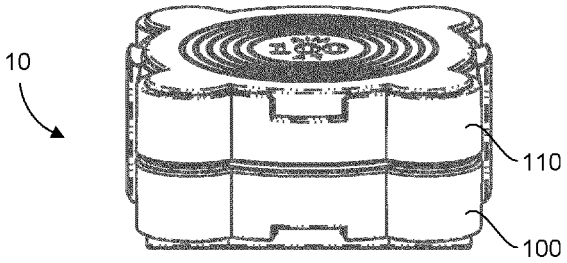
FIG. 2B is a front view of the assembled leg exercise apparatus of FIG. 1B in the closed position.
Figure 3B:
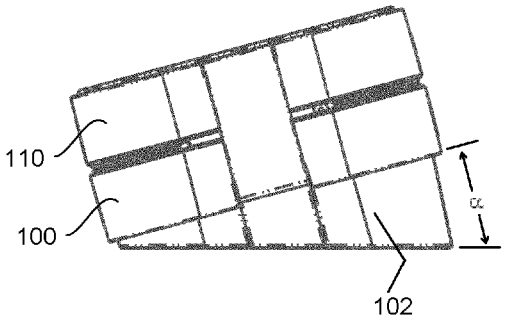
FIG. 3B is a right side view of the assembled leg exercise apparatus of FIG. 1B in the closed position.
Figure 3C:
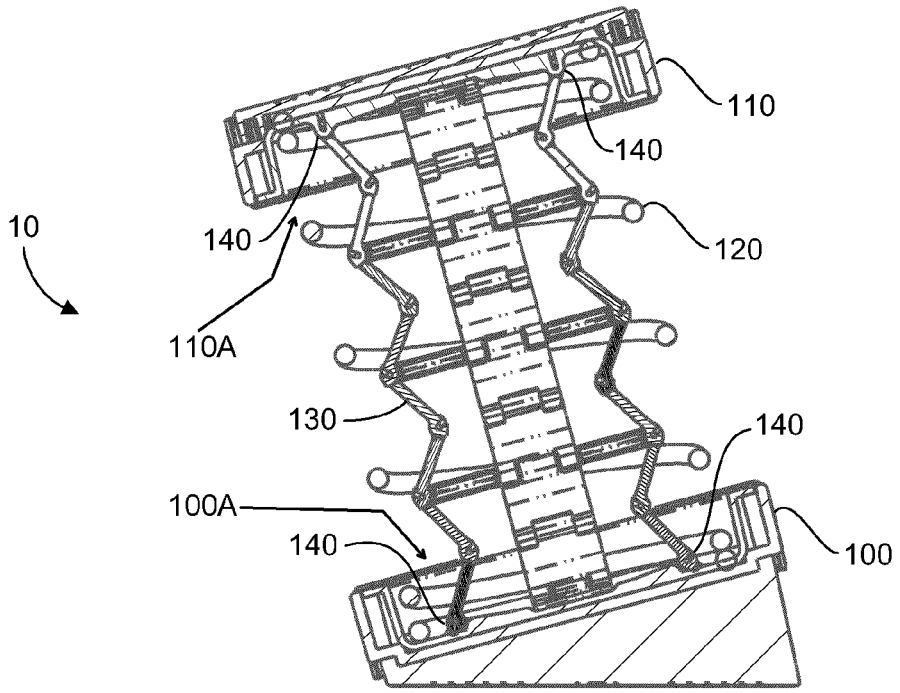
FIG. 3C is a cross-sectional view of the assembled leg exercise apparatus in FIG. 3A.
Figure 4:
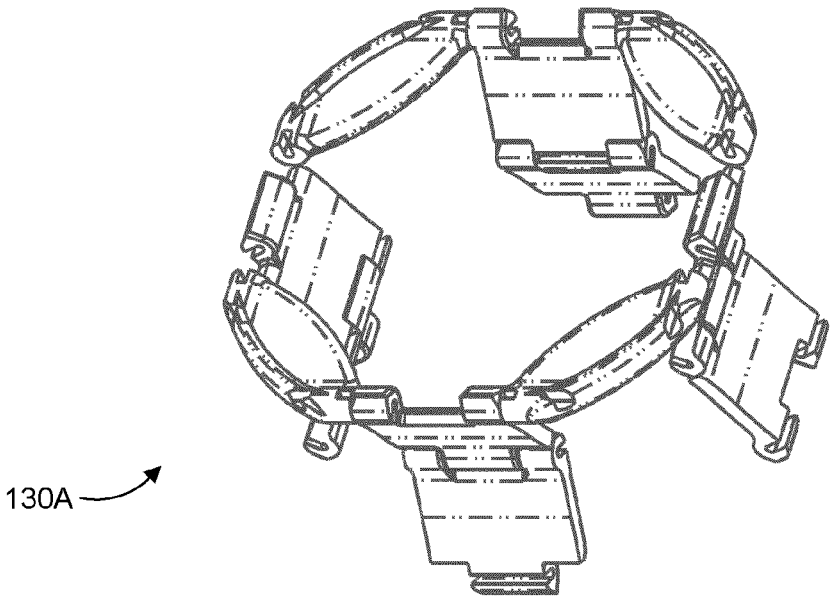
FIG. 4 is a top perspective view of a portion of one embodiment of the alignment mechanism.
Figure 5:
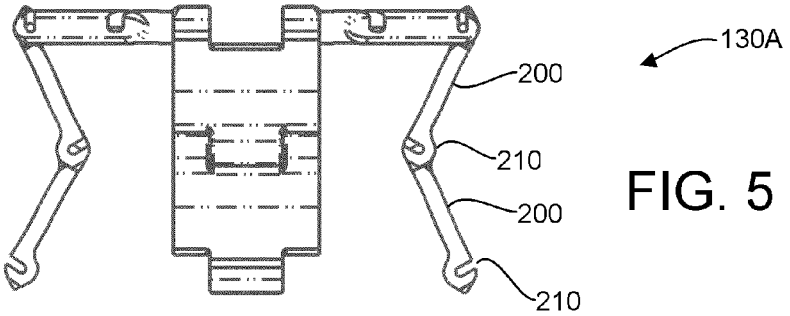
FIG. 5 is a front view of the alignment mechanism in FIG. 4.

As shown in FIG. 1-3C the exercise apparatus 10 can include a base member 100 with a base support 102 and a top member or platform 110 movable relative to the base member 100. A resilient member 120 can be interposed between the base member 100 and the top platform 110. In one embodiment, as shown in FIG. 1A, the resilient member 120 can be a coil spring. However, in other embodiments, the resilient member can be a hydraulic assembly (e.g., piston-cylinder assembly) or a pneumatic assembly (e.g., piston-cylinder assembly). In still another embodiment, the resilient member can include a compressible elastic material (e.g., rubber bumper). As best shown in FIG. 3C, the base member 100 and top member 110 can each have a recess 100A, 110A into which at least a portion of the resilient member 120 extends so that the spring bears against a surface of said recesses 100A, 110A. In one embodiment, the resilient member 120 can be fixedly coupled within said recesses 100A, 110A to the base and top members 100, 110.

With continued reference to FIGS. 1-3C, the exercise apparatus 10 can also include a frame assembly 130 interposed between the base member 100 and the top platform 110. In the illustrated embodiment, the frame assembly 130 can extend coaxially with the resilient member 120. In one embodiment, the frame assembly 130 can extend within the resilient member 120 so that it is circumscribed by the resilient member 120. In another embodiment, the frame assembly 130 can be disposed about the resilient member 120 such that it circumscribes the resilient member 120. Operation of the frame assembly 130 is further described below.

As best seen in FIGS. 3A and 3B, the base support 102 has a bottom surface 102A that contacts the ground surface on which the exercise apparatus 10 is placed. In one embodiment, the bottom surface 102A can grip the ground surface to inhibit sliding or shifting of the base support 102 during use of the exercise apparatus 10 (e.g., when the user is pushing down on the top member or platform 110 with their foot. For example, in one embodiment, the bottom surface 102A can have a tread (e.g., non-slip surface). The base support 102 can have a generally triangular configuration such that the base support 102 and top platform 110 can extend along planes at an angle $\alpha$ relative to the support surface. The angle $\alpha$ can range between about 5 degrees and about 45 degrees. However, in other embodiments other suitable angles can be used. In one embodiment, said angle $\alpha$ orients the top platform 110 relative to the ground surface to facilitate placement of the user's foot on the platform during use for more efficient use of the exercise apparatus 10. In one embodiment, the base member 100 and base support 102 are a single piece (e.g., monolithic piece molded together). In another embodiment, the base support 102 can be detachably coupled to the base member 100.

Figure 1A:
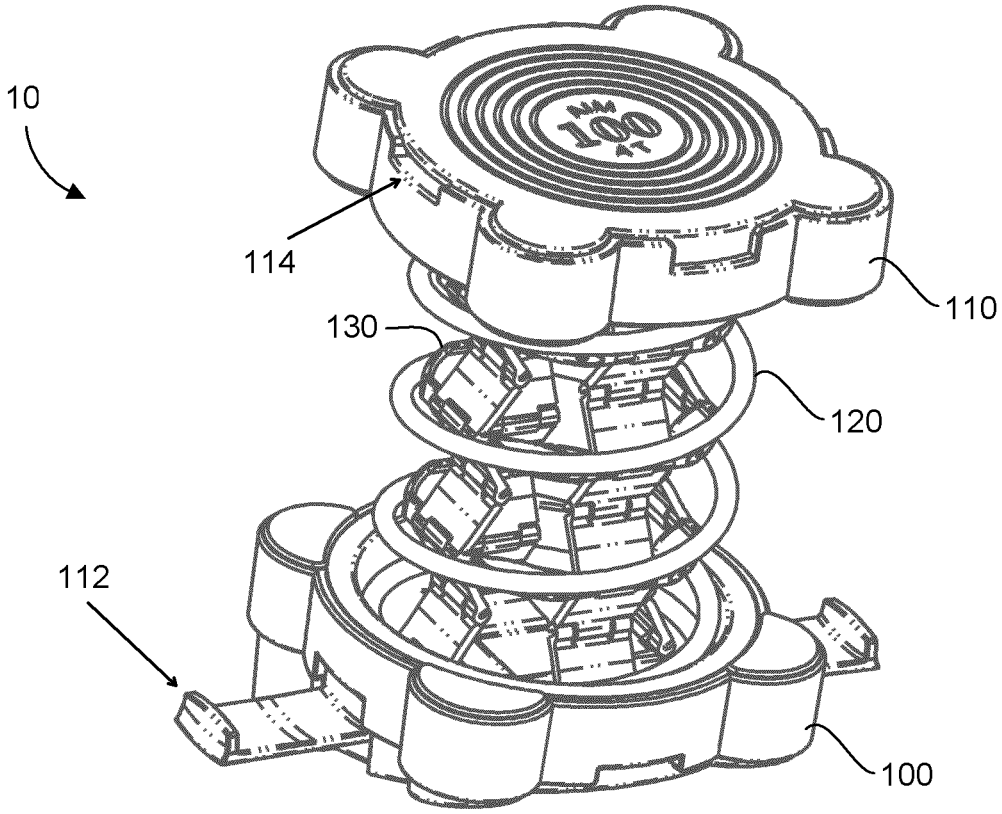
FIG. 1A is a perspective top view of one embodiment of the assembled leg exercise apparatus in the open position.
Figure 1B:
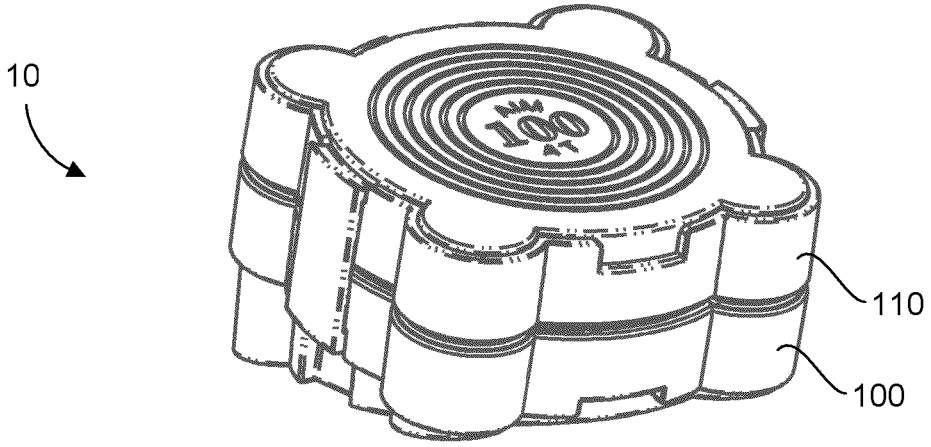
FIG. 1B is a perspective top view of one embodiment of the assembled exerciser in the closed position.
Figure 2A:
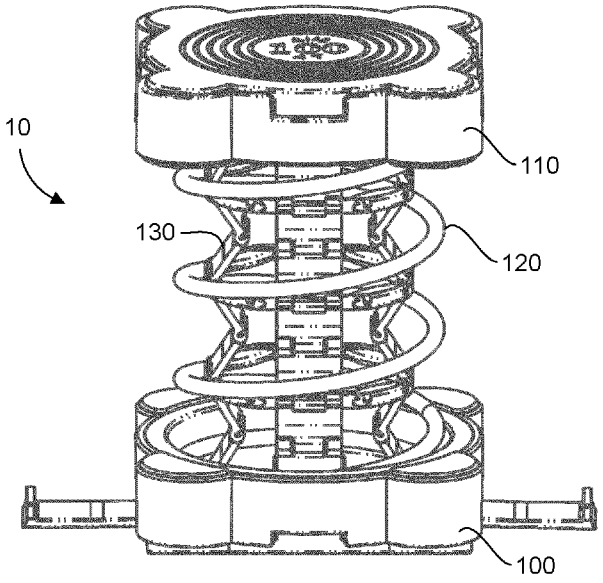
FIG. 2A is a front view of the assembled leg exercise apparatus of FIG. 1A in the open position.

As best shown in FIGS. 1A-1B, the exercise apparatus 10 can move between a collapsed configuration (shown in FIG. 1B) and an extended configuration (shown in FIG. 1A). In the collapsed configuration, the top platform 110 can be adjacent (e.g., in contact with) the bottom member 100. In one embodiment, the top platform 110 can be held in the collapsed configuration via one or more coupling members 112 that couple the base member 100 to the top platform 110. In the illustrated embodiment, the one or more coupling members 112 are clips pivotally coupled to the base member 100 that releasably engage recesses 114 on a surface of the top platform 110. However, in other embodiments, the coupling members 112 can be other suitable mechanisms that fixedly couple the top platform 110 to the base member 100.

The frame assembly 130 can advantageously align the top platform 110 and the base member 100 such that the top platform 110 is oriented generally parallel to the base member 100 as it travels along an axis Y (see FIG. 3A) toward and away from the base member 100. Additionally, the frame assembly 130 can advantageously inhibit rotation of the top member 110 about the axis Y relative to the base member 100 to thereby allow axial, non-twisting motion of the top member 110 relative to the base member 100. As shown in FIG. 3C-15A, the frame assembly 130 can include a plurality of frame sections 130A pivotally coupled to each other. In one embodiment, the frame sections 130A can be hingedly coupled to each other, allowing each of the frame sections 130 to move relative to adjacent frame sections 130A as the exercise apparatus 10 moves to the extended or collapsed configurations. As shown in FIG. 3C, the frame assembly 130 is hingedly coupled to the top platform 110 and base member 100. In one embodiment, the frame assembly 130 is coupled to the top platform 110 and base member 100 with two or more hinged connections, in another embodiment with three or more hinged connections, and in still another embodiment with four hinged connections.

The frame assembly 130 mechanically constrains the exercise apparatus 10 to move in substantially a linear direction so that the forces applied by the apparatus 10 (e.g., on the user's leg) are more predictable, allowing the user to build a desired muscle group. Without the linear motion, a user would also need to balance forces, causing other muscles to be used, thus leading to a less effective exercise routine. In addition, the linear constraint helps ensure forces are not released in an unpredictable manner when using the exercise apparatus 10, thereby making the product safer to use by inhibiting the ability of the resilient member 120 to bend away from its central axis of motion during use. Such bending could cause the resilient member to suddenly uncontrollably release its energy at a non-parallel angle to its central axis of motion. By constraining the motion of travel, the product is more effective and safer to use.

With continued reference to FIGS. 3C-15A, each of the frame sections 130A can include leaves 200, each leaf 200 defining axes 210 at two opposing sides, where the leaves 200 are pivotally coupled to each other via a hinged connection therebetween along the axes 210 to define a hinged pair 220. When these hinge leaves 200 are connected into a hinge pair (220) as in FIGS. 11A and 11B, the axes 210 of both hinges lie in a common motion plane. However, nothing is constraining them within this plane. A similar hinge pair must be placed at an angle not parallel to the first hinge pair with two axes lying in a common plane with one another. In one embodiment, magnets arranged to repel one another can be disposed in one or more of the frame sections 130A to bias the frame assembly 130 toward the extended configuration. In one embodiment, the resilient member 120 can be excluded and instead the hinged connection between each hinged pair 220 be spring loaded to apply a resisting force to motion of the frame assembly 130 to the collapsed position.

Figure 6:
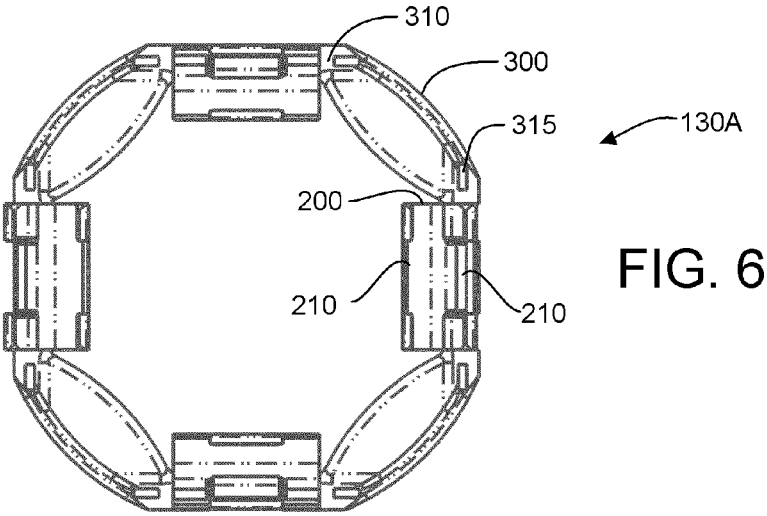
FIG. 6 is a top view of the alignment mechanism in FIG. 4.
Figure 7:
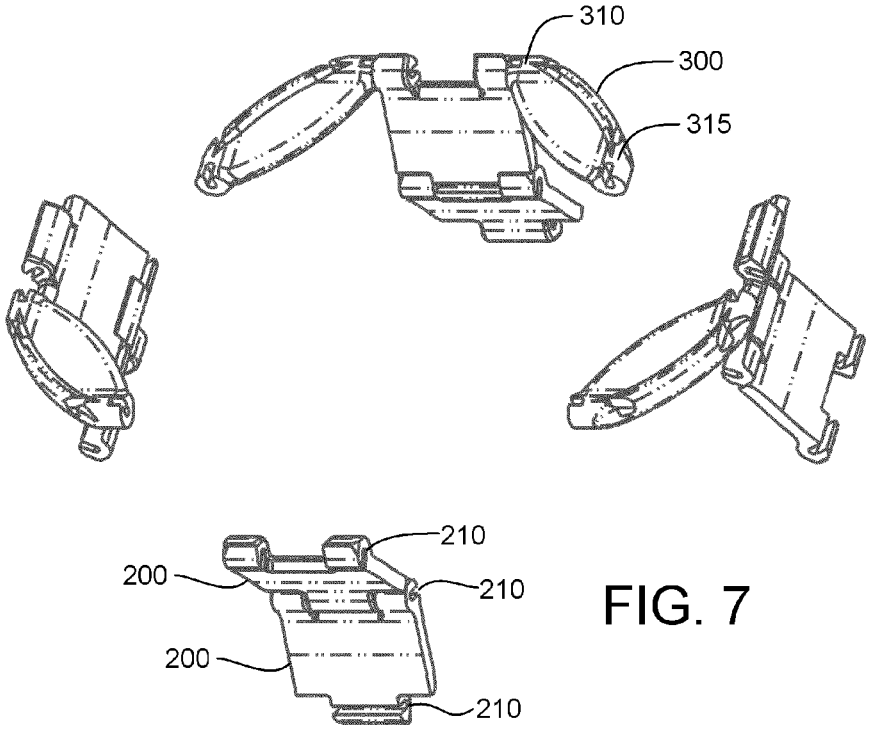
FIG. 7 is an exploded view of the alignment mechanism in FIG. 4.
Figure 8:
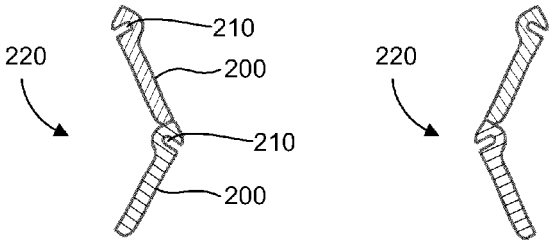
FIG. 8 is a cross-sectional view of the alignment mechanism of FIG. 5 in the extended position.
Figure 9:
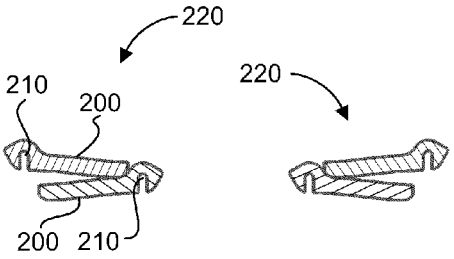
FIG. 9 is a cross-sectional view of the alignment mechanism of FIG. 5 in the collapsed position.
Figure 10:
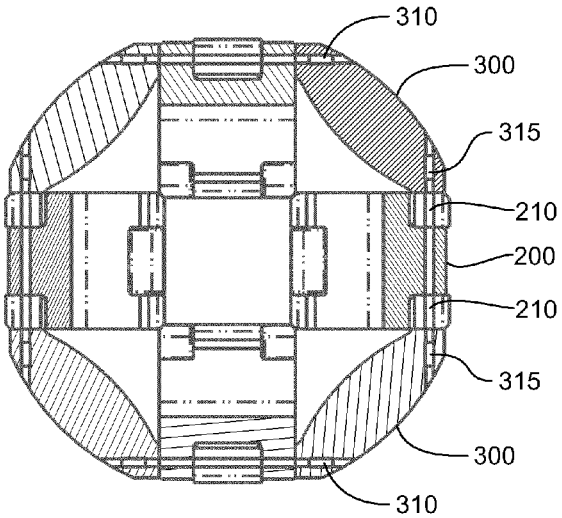
FIG. 10 is a top view of one level of the alignment mechanism.
Figure 11A:
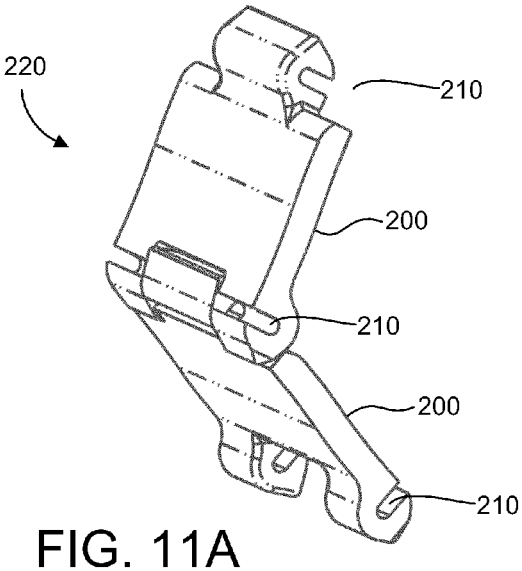
FIG. 11A is a perspective view of one embodiment of a hinge leaf pair in an extended position.
Figure 11:
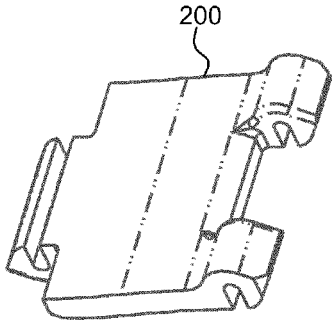
FIG. 11 is perspective view of one embodiment of a hinge leaf.
Figure 12:
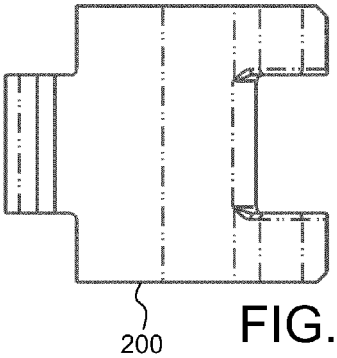
FIG. 12 is a top view of the hinge leaf of FIG. 11.
Figure 11B:
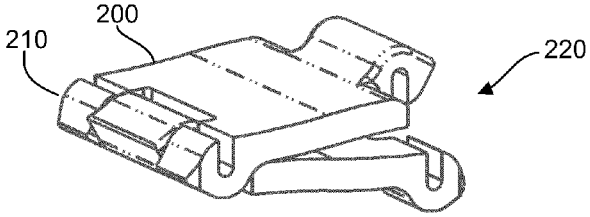
FIG. 11B is a perspective view of the hinge leaf pair of FIG. 11A in a collapsed position.
Figure 13:
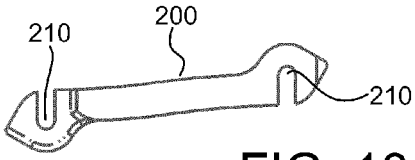
FIG. 13 is a side view of the hinge leaf of FIG. 11.
Figure 15:
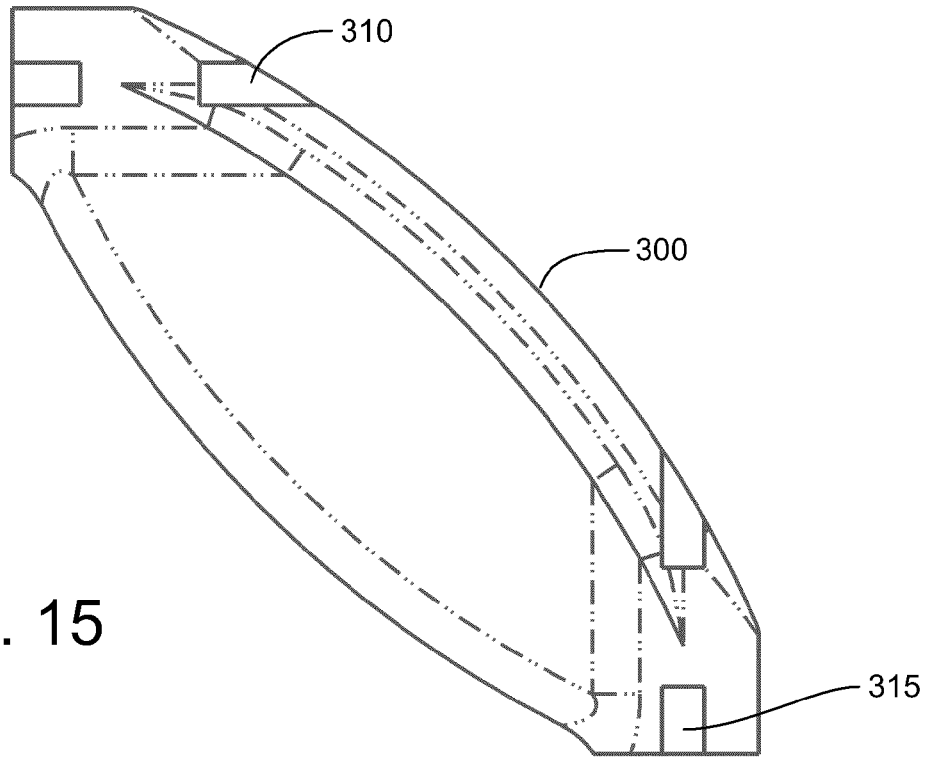
FIG. 15 is a top view of one embodiment of a connecting link.
Figure 15A:
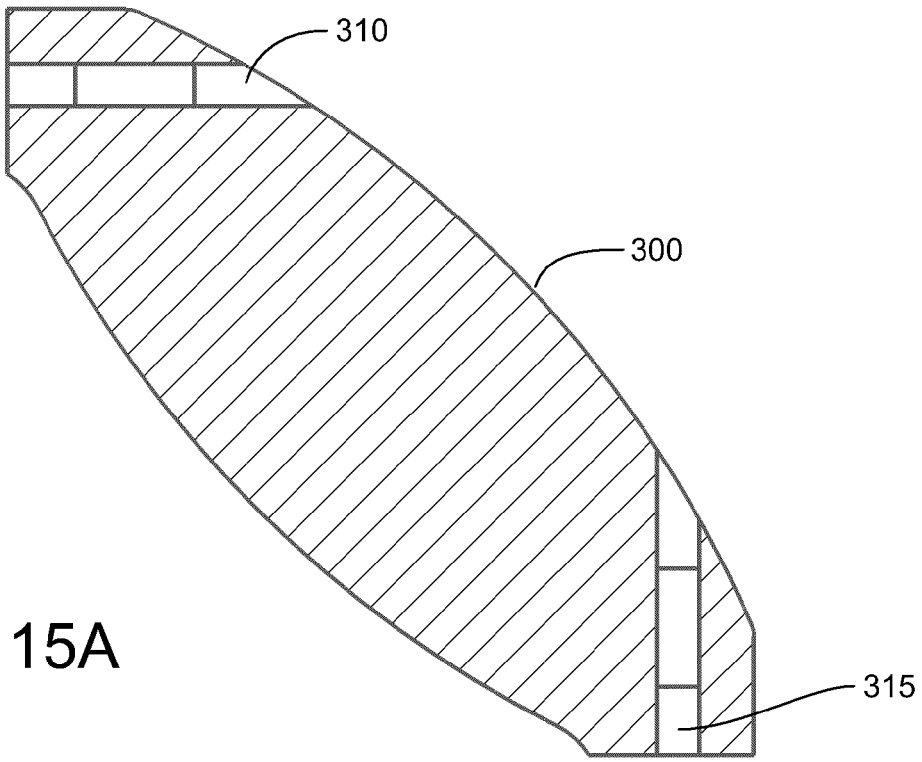
FIG. 15A is a cross-sectional view of the connecting link in FIG. 15.

Referring to FIG. 10 and FIGS. 15 and 15A, each hinge pair 220 is connected to a connecting link 300 through their respective hinge axes 210. One hinge pair 220 is connected to axis 310 of connecting link 300 while another hinge pair 220 is connected to a non-parallel axis 315 of the connecting link. Through this connection, each hinge pair is constrained to the linear motion of its neighboring hinge pair 220, thereby constraining the frame assembly 130 to said linear motion. By connecting three or more hinge pairs 220 in such fashion, the frame mechanism 130 is further made rigid, inhibiting twisting motion of the top platform 110 relative to the base member 100. As shown in FIG. 6, the leaves 200 and connecting links 300 define a frame section 130A that is ring-shaped.

Figure 14:
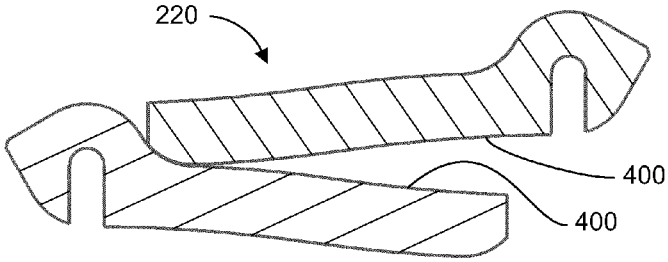
FIG. 14 is a cross-sectional view of the hinge leaf pair in FIG. 11B.

With reference to FIG. 14, each hinge connection of the pair of leaves 220 is shaped to allow gradual contact between the leaves 200 as they collapse onto each other when the exercise apparatus 10 moves to the collapsed orientation (e.g., when the user pushes down on the top platform 110), thereby reducing generation of noise from the frame assembly 130 due to the contact between the leaves 200. In one embodiment, the hinge portion of each of the leaves 200 is s-shaped, thereby allowing for gradual contact between the leaves 200 when moved to the collapsed configuration, and over a much smaller surface area. This gradual contact and reduced surface area disperses the energy over a longer time frame thereby reducing the emitted sound dramatically while maintaining a compact size of the frame assembly 130. In contrast, if the hinged leaves were flat such that they contacted each other along their entire surface, an undesirable sound would be generated by the frame assembly when moved to the collapsed configuration.

In another embodiment, where a non-linear or rounded arc motion is desired for the exercise apparatus 10, the geometry on which the hinges lie in the frame assembly 130 will not be on a common plane, but rather they should lie on a cylindrical, conical or spherical geometry.

The base member 100, base support 102 and top platform or member 110 can be made of rigid plastic (e.g., molded plastic). However, other suitable materials (e.g., metal) can be used. The frame assembly 130 can in one embodiment be made of a rigid plastic material. However, in other embodiments other suitable materials (e.g., metal) can be used.

As discussed herein, the exercise apparatus 10 is compact, lightweight, portable and suitable for use while traveling or at the office. In one embodiment, the exercise apparatus 10 can have a height of between about 5 inches and 10 inches when extended, and about 2 inches and 4 inches when collapsed. Each exercise apparatus 10 can have a footprint dimension of about 4 to 6 inches by about 4 to 6 inches (e.g., the platform 110 sized to receive one foot thereon). In one embodiment, a pair of exercise apparatuses 10 can weigh less than about 5 lbs. (e.g., less than 4 lbs., less than 3 lbs.). However, in other embodiments, the exercise apparatus can have other suitable dimensions and weight for use for leg exercise.

Due to its compact size, the exercise apparatus 10 can be used under a desk to allow continuous exercise throughout the workday. Office workers could perform exercises while seated in an office chair during typical office tasks. This safe and gentle form of low impact exercise is also perfect for seniors when they prefer exercising at home. Since chair exercises cause less stress on a person's knees than other forms of exercise, the exercise apparatus 10 is an ideal tool for increasing blood circulation in the user's legs and working back into shape (e.g., after an injury when the user is less mobile and cannot leave the house).

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A compact portable leg exercise device, comprising:

a base member positionable on a support surface;

a top platform disposed above and generally parallel to a plane defined by the base member and configured to move generally axially relative to the base member, the top platform configured to receive a user's foot thereon during use of the leg exercise device;

a resilient member interposed between the base member and top platform and extending about an axis of the device; and a frame assembly fixedly coupled to and interposed between the top platform and base member, the frame assembly being co-axial with the resilient member, the frame assembly configured to move between an extended configuration and a collapsed configuration to facilitate axial movement of the top platform relative to the base member while inhibiting twisting of the top platform about the axis, the frame assembly comprising a plurality of hinged sections where each hinged section is defined by a pair of members that fold onto each other and gradually contact each other when the frame assembly moves toward the collapsed configuration, thereby inhibiting noise generation by the frame assembly during use, wherein in the extended configuration the top platform is supported solely by the resilient member and the frame assembly, wherein during use a user presses the top platform with their foot to move the top platform generally axially toward the base member and against a force exerted by the resilient member on the top platform during said motion.

2. The exercise device of claim 1, wherein the resilient member is a coil spring.

3. The exercise device of claim 1, wherein the frame assembly is disposed within a periphery of the resilient member such that the resilient member circumscribes the frame assembly.

4. The exercise device of claim 1, wherein the frame assembly is pivotally coupled to the base member and top platform.

5. The exercise device of claim 1, wherein said axis extends at a non-perpendicular angle relative to a bottom surface of the exercise device.

6. The exercise device of claim 5, wherein said angle is between about 5 degrees and about 45 degrees.

7. The exercise device of claim 1, further comprising one or more coupling members configured to fixedly couple the top platform to the base member when the exercise device is in the collapsed configuration, thereby facilitating storage or portability of the exercise device.

8. The exercise device of claim 7, wherein the one or more coupling members comprise a pair of clips pivotally coupled to the base member, each of the clips configured to couple to a recessed portion of the top platform.

9. A compact portable leg exercise device, comprising:

a base member positionable on a support surface;

a top platform disposed above and generally parallel to a plane defined by the base member and configured to move axially relative to the base member, the top platform configured to receive a user's foot thereon during use of the leg exercise device;

a coil spring interposed between the base member and top platform and extending about an axis of the device, said axis extending at a non-perpendicular angle to a bottom surface of the base member; and a frame assembly fixedly coupled to and interposed between the top platform and base member, the frame assembly being co-axial with the coil spring, the frame assembly configured to move between an extended configuration and a collapsed configuration to facilitate axial movement of the top platform relative to the base member while inhibiting twisting of the top platform about the central axis, the frame assembly comprising a plurality of hinged sections where each hinged section is defined by a pair of members that fold onto each other and gradually contact each other when the frame assembly moves toward the collapsed configuration, thereby inhibiting noise generation by the frame assembly during use, wherein in the extended configuration the top platform is supported solely by a resilient member and the frame assembly, wherein during use a user a user presses the top platform with their foot to move the top platform generally axially toward the base member and against a force exerted by the resilient member on the top platform during said motion.

10. The exercise device of claim 9, wherein the frame assembly is disposed within a periphery of the coil spring such that the coil spring circumscribes the frame assembly.

11. The exercise device of claim 9, wherein the frame assembly is pivotally coupled to the base member and top platform.

12. The exercise device of claim 9, wherein said angle is between about 5 degrees and about 45 degrees.

13. The exercise device of claim 9, further comprising one or more coupling members configured to fixedly couple the top platform to the base member when the exercise device is in the collapsed configuration, thereby facilitating storage or portability of the exercise device.

14. The exercise device of claim 13, wherein the one or more coupling members comprise a pair of clips pivotally coupled to the base member, each of the clips configured to couple to a recessed portion of the top platform.

15. The exercise device of claim 9, wherein a bottom surface of the exercise device is a non-slip surface.

16. A compact portable leg exercise device, comprising:

a base member positionable on a support surface;

a top platform disposed above and generally parallel to a plane defined by the base member and configured to move axially relative to the base member, the top platform configured to receive a user's foot thereon during use of the leg exercise device;

a coil spring interposed between the base member and top platform and extending about an axis of the device, said axis extending at a non-perpendicular angle to a bottom surface of the base member; and a frame assembly fixedly coupled to and interposed between the top platform and base member, the frame assembly being co-axial with and disposed within a periphery of the coil spring such that the coil spring circumscribes the frame assembly, the frame assembly comprising a plurality of hinged sections where each hinged section is defined by a pair of members that fold onto each other and gradually contact each other when the frame assembly moves toward the collapsed configuration, thereby inhibiting noise generation by the frame assembly during use, the frame assembly configured to move between an extended configuration and a collapsed configuration to facilitate axial movement of the top platform relative to the base member while inhibiting twisting of the top platform about the central axis, wherein in the extended configuration the top platform is supported solely by a resilient member and the frame assembly, wherein during use a user presses the top platform with their foot to move the top platform generally axially toward the base member and against a force exerted by the resilient member on the top platform during said motion.

17. The exercise device of claim 16, wherein the frame assembly is pivotally coupled to the base member and top platform.

18. The exercise device of claim 16, wherein said angle is between about 5 degrees and about 45 degrees.

19. The exercise device of claim 16, further comprising one or more coupling members configured to fixedly couple the top platform to the base member when the exercise device is in the collapsed configuration, thereby facilitating storage or portability of the exercise device.

* * * * *